United States Patent [19]

Katahira et al.

[11] 4,362,038

[45] Dec. 7, 1982

[54] WIRE FORMING APPARATUS FOR TORSION SPRINGS

[75] Inventors: Sota Katahira, Yokohama; Hideaki Tsukioka, Kawasaki; Yutaka Sakuma, Yokosuka; Hideo Higuchi, Shiga, all of Japan

[73] Assignee: Keihin Hatsujyo Company Limited, Kanagawa, Japan

[21] Appl. No.: 144,812

[22] Filed: Apr. 29, 1980

[30] Foreign Application Priority Data

Sep. 19, 1979 [JP] Japan ..... 54-119252

[51] Int. Cl.[3] ..... B21F 3/04

[52] U.S. Cl. ..... 72/130; 72/137

[58] Field of Search ..... 72/129, 130, 131, 135, 72/137, 142; 140/103, 104

[56] References Cited

U.S. PATENT DOCUMENTS

| | | | |
|---|---|---|---|
| 3,470,721 | 10/1969 | Scheublein et al. | 72/144 |
| 3,906,766 | 9/1975 | Sato | 72/132 |
| 4,026,135 | 5/1977 | Yagusic | 72/142 X |
| 4,048,825 | 9/1977 | Dastrup | 72/12 |
| 4,064,732 | 12/1977 | Matsuoka | 72/142 X |
| 4,112,721 | 9/1978 | Takase | 72/142 |

*Primary Examiner*—Leon Gilden

*Attorney, Agent, or Firm*—Sughrue, Mion, Zinn, Macpeak & Seas

[57] ABSTRACT

A wire forming apparatus for torsion springs is disclosed. This apparatus comprises servomotors for performing the rotational and axial movement of an arbor and the feeding of a wire, a terminal forming mechanism, a cutting mechanism, a microcomputer for driving the servomotors, the terminal forming mechanism and the cutting mechanism, and various detecting mechanisms disposed at each constructional part for performing feedback control through the microcomputer.

5 Claims, 8 Drawing Figures

WIRE FORMING APPARATUS FOR TORSION SPRINGS

BACKGROUND OF THE INVENTION

This invention relates to a wire forming apparatus for torsion springs capable of producing the torsion springs automatically and accurately.

In FIG. 1 is perspectively shown a typical example of a torsion spring 1, which is not subjected to a terminal forming. In order to produce such torsion spring 1, there have been used apparatuses for the production of the torsion spring using a rotatable roller feed system or a reciprocable gripper feed system. In this case, a wire is fed into an arbor portion and inserted between an arbor and a pawl formed in an arbor holder, and thereafter the arbor is rotated only at a required number of revolutions and simultaneously moved toward its axial direction at a predetermined pitch while the wire is subjected to the terminal forming before and after the revolution of the arbor. Thereafter the resulting torsion spring is cut down in a given shape.

In such apparatuses for the production of the torsion spring, the adjustment of the number of revolutions of the arbor in the winding of the wire is carried out by regulating a sliding stroke or a rack bar in a crank slide mechanism, but the winding time is required to be a half cycle of the crank, so that the forming, cutting and feeding time of the wire is restricted to the residual half cycle of the crank. Therefore, when plural tools required for the forming are employed to perform a complicated forming, it is frequently difficult to actuate such tools in a given time and further errors of winding angle and feeding length of the wire may not be ignored due to a clearance of gears, wear of each sliding parts and the like.

Therefore, there have been made various attempts to control the revolution of the arbor by means of an electromagnetic clutch, electromagnetic brake or the like, to shorten the rotating time of the arbor in one cycle, and to use a stepping motor or the like. In any case, the conventional wire forming apparatuses for the production of the torsion spring uses a single driving source for the rotation of the arbor, the axial movement of the arbor and the feeding of the wire, and also adopts a mechanically automatic speed changing mechanism for the axial movement of the arbor during the revolution of the arbor, normally the upward movement thereof. Therefore, serious problems such as slipping and the like are caused.

SUMMARY OF THE INVENTION

The objective of the invention is to solve the above mentioned drawbacks of the conventional technique and to provide an apparatus for the production of the torsion springs which automatically performs the rotational and axial movement of the arbor, the feeding, the terminal forming and the cutting of the wire and the like by control signals from a microcomputer supplied with data required for the production of the torsion spring.

A further object is to prevent the production of inferior products by detecting the propriety of each constructional part by means of detecting mechanisms and which enables the apparatus to continuously and easily produce the torsion spring with a higher dimensional accuracy without being influenced by the minute variation of properties of the wire by supplying control signals from the detecting mechanisms into the microcomputer to perform automatic correction of the stored program.

According to the invention, there is provided a wire forming apparatus for the production of a torsion spring, comprising servomotors for performing rotational and axial movement of an arbor and feeding a wire, a forming mechanism for terminal forming, a cutting mechanism for the wire, and various detecting mechanisms required for each constructional part; the driving of these servomotors, the forming mechanism and the cutting mechanism being performed with each other in a synchronous state by control signals read out from a central information processing unit of a microcomputer on a basis of data supplied by a memory unit of the microcomputer, and the selection of inferior product and self-correction of the stored memory being performed by feeding back control signals from the detecting mechanisms into the microcomputer in the forming of the torsion spring.

BRIEF DESCRIPTION OF THE DRAWINGS

The invention will now be described in greater detail with reference to the accompanying drawings, wherein.

DESCRIPTION OF THE PREFERRED EMBODIMENTS

Figure 1:
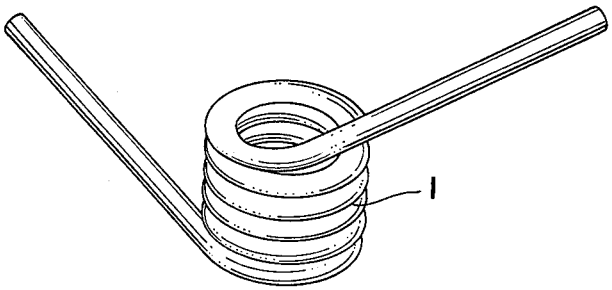
FIG. 1 is a perspective view of an embodiment of a torsion spring subjected not to a terminal forming as mentioned above.
Figure 2:
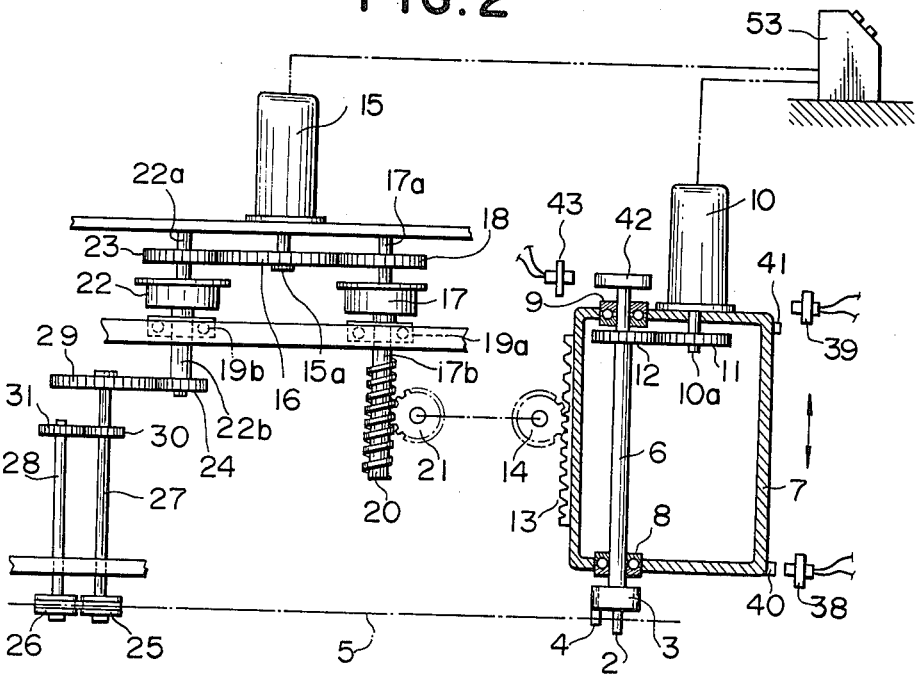
FIG. 2 is a diagrammatic view of main mechanism part of an embodiment of the apparatus for the production of the torsion spring according to the invention.
Figure 3:
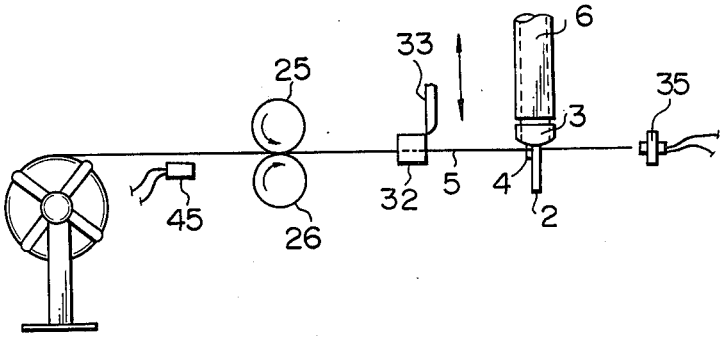
FIG. 3 is a schematical view of a wire feeding mechanism in an embodiment of the apparatus according to the invention.

In FIGS. 2 and 3 is shown an embodiment of the apparatus for the production of torsion springs according to the invention, wherein a torsion spring 1 as shown in FIG. 1 is further shaped out to a terminal forming, if necessary.

As shown in these figures, an arbor 2 with a diameter corresponding to a center diameter of the torsion spring 1 is mounted on an arbor holder 3. This arbor holder 3 is provided with a pawl 4 so as to insert a wire 5 between the pawl 4 and the arbor 2. The arbor holder 3 is mounted on a spindle 6, which is rotatably supported by means of bearings 8 and 9 attached to a spindle box 7. A servomotor 10 is also mounted on the spindle box 7, whereby a gear 11 mounted to a motor shaft **10*a* is engaged with a gear 12 mounted to the spindle 6 so that the wire 5 around the arbor 2 is to be wound by means of rotation of a winding mechanism driven by the servomotor 10**.

To the spindle box 7 is secured a rack bar 13, which is engaged with a pinion 14. Therefore, by rotating the pinion 14, the spindle box 7 is reciprocally moved with respect to the apparatus body for the production of the torsion spring and at the same time the arbor 2 is reciprocally moved in its axial direction. Another servomotor 15 is provided on the apparatus body and a gear 16 is mounted to a motor shaft 15*a* of the servomotor 15. The gear 16 engages with a gear 18 mounted to an input shaft 17*a* of an electromagnetic clutch 17. Moreover, an output shaft 17*b* of the electromagnetic clutch 17 is supported through a bearing 19*a* and provided with a worm 20. A worm wheel 21 engaging with the worm 20 is mechanically connected to the pinion 14. Thus, when the servomotor 15 rotates by the actuation of the electromagnetic clutch 17, the arbor 2 is moved in the axial direction. In the illustrated embodiment, the spindle box 7 and arbor 2 are moved in an up-and-down direction, whereby the torsion spring 1 wound on the arbor 2 may naturally be fallen down. Of course, in the invention the movement of the arbor 2 is not limited to the up-and-down direction only.

Further, the gear 16 mounted to the output shaft 15*a* of the servomotor 15 engages with a gear 23 mounted to an input shaft 22*a* of another electromagnetic clutch 22. An output shaft 22*b* of the electromagnetic clutch 22 is supported through a bearing 19*b* and provided with a gear 24. Feed rollers 25 and 26 for the feeding of the wire 5 are rotatably attached to the apparatus body through rotary shafts 27 and 28, respectively, wherein a gear 29 mounted to the rotary shaft 27 engages with the gear 24 and at the same time gears 30 and 31 with the same diameter are mounted to the rotary shafts 27 and 28, respectively. Therefore, when the servomotor 15 rotates during the connection of the electromagnetic clutch 22, the feed rollers 25 and 26 are rotated in an opposite direction at the same speed to feed the wire 5 into the arbor 2.

In the illustrated embodiment, the servomotor for moving the arbor 2 in the axial direction and the servomotor for feeding the wire 5 into the arbor 2 are constructed by the common servomotor 15. This is due to the fact that the use of two servomotors is not necessary as apparent from the following and the increase of the cost can be suppressed. However, it is possible to separately use the two servomotors so that the invention is not intended to limited to the illustrated embodiment.

Further, the apparatus body is provided with a cutting mechanism for the wire 5. This cutting mechanism is structured with a fixed cutting guide 32 and a cutting blade 33 as shown in FIG. 3. The cutting blade 33 can be driven by an actuator or the like, which is controlled by an action of, for example, an electromagnetic valve. In addition, the apparatus body is provided with a forming mechanism for performing a terminal forming to front and rear ends of the torsion spring 1. In the forming mechanism there may be adopted some tools having a conventionally known structure. The tools may be driven by an actuator or the like which is controlled by an action of an electromagnetic valve for example. Moreover, the servomotor may be used to drive the cutting mechanism and the forming mechanism, but the use of the servomotor is not necessary in the usual case.

Figure 4:
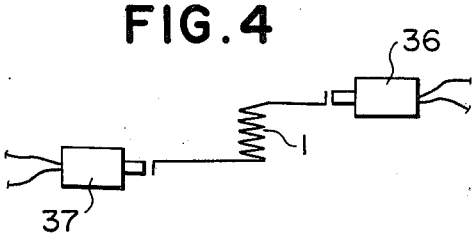
FIGS. 4–6 are schematical views illustrating the detecting mechanisms to be used in an embodiment of the apparatus according to the invention.
Figure 5:
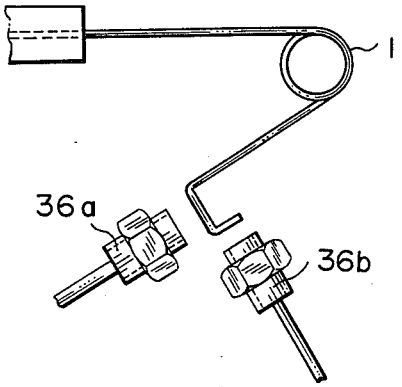

In the illustrated embodiment, the apparatus for the production of torsion springs is provided with various detecting mechanisms whereby the selection of inferior an product can be performed and also the production itself of an inferior product can be prevented by feeding back the adjustment of the dimensions to the control portion of the apparatus body. That is, when the slipping is caused between the feed rollers 25, 26 and the wire 5, even if the running accuracy of the feed rollers 25, 26 is increased as far as possible, the length of the front end portion of the torsion spring 1 can not be made the same. Therefore, as shown in FIG. 3, a detecting head 35 for the detecting mechanisms is disposed at a predetermined position spaced apart from the arbor 2 so as to make constant a feeding length of the wire 5. In case of the terminal forming, detecting heads 36, 37 for the detecting mechanisms at each terminal of the resulting spring are provided so as to detect the fitness of the terminal shape after the terminal forming as shown in FIG. 4. In this case, plural detecting heads 36*a*, 36*b* corresponding to the terminal shape may be provided as shown in FIG. 5.

In order to detect the limit position of reciprocal movement of the arbor 2 in the axial direction, there are provided detecting heads 38, 39 for the detecting mechanisms and projections 40, 41 for actuating these detecting heads. At the beginning of the winding of the wire 5, it is required to insert the wire 5 fed by the feed rollers 25, 26 between the pawl 4 of the arbor holder 3 and the arbor 2, so that it should be governed to always return the position of the pawl 4 to the original portion. Now, a disk plate 42 having, for example, one protrusion is fixed to the upper end of the spindle 6 opposite to the arbor holder 3 and a detecting head 43 is provided face to face with the disk plate 42 as shown in FIG. 2.

Figure 6:
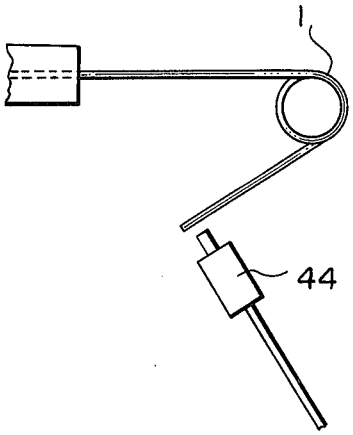

In addition, a winding angle of the torsion spring 1 varies depending upon the hardness of the wire 5 and the like so that a detecting head 44 acting as a detecting mechanism for detecting the variance of the winding angle is provided as shown in FIG. 6. It is desirable to automatically stop the operation of the apparatus for the production of torsion springs when the wire 5 runs out, so a detecting head 45 for detecting the end of the wire 5 is provided as shown in FIG. 3.

Figure 7:
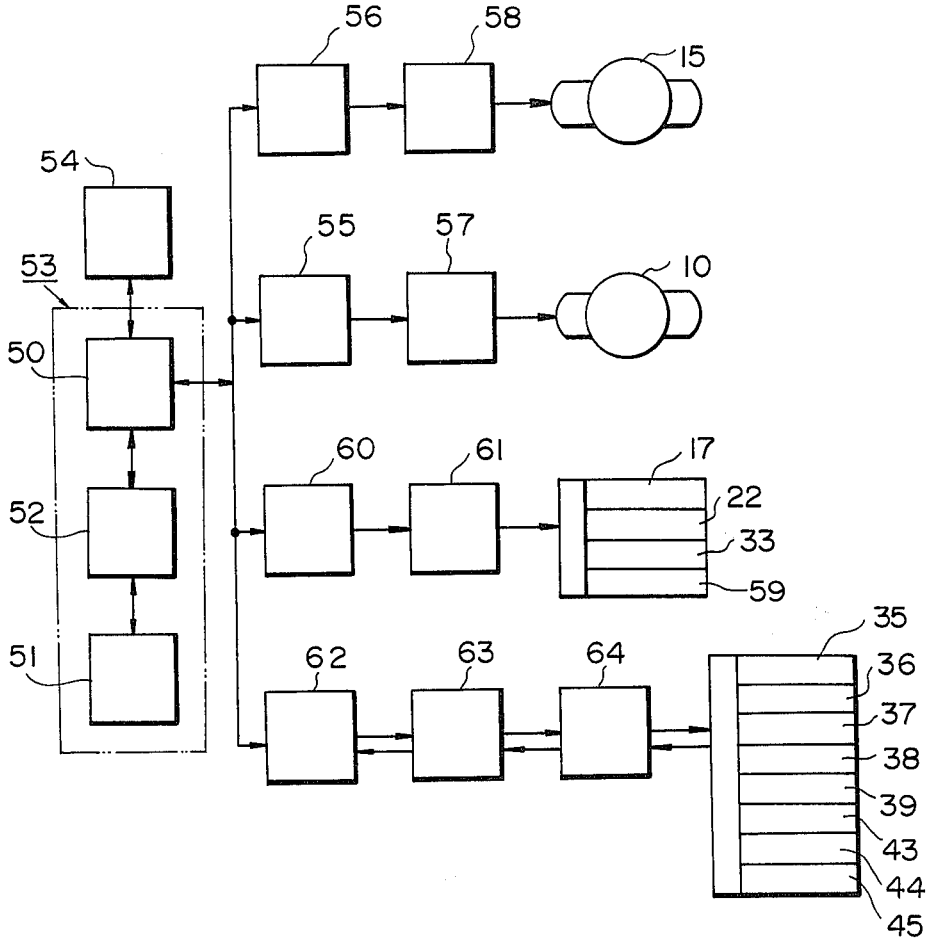
FIG. 7 is a block diagram of a control system of an embodiment of the apparatus according to the invention.

In FIG. 7 is shown a block diagram illustrating a control system of an embodiment of the wire forming apparatus for the production of torsion springs according to the invention, wherein each numeral corresponds to the numeral shown in FIGS. 1–6. In other words, the apparatus for the production of torsion springs according to the invention includes a microcomputer 53 and an input unit 54. The microcomputer 53 comprises a memory unit and a central information processing unit (CPU) 50, an auxiliary memory unit 51 and a card interface 52. The input unit 54 supplies necessary data for forming the torsion spring into the microcomputer 53.

Furthermore, pulse distribution circuits 55, 56 and servo interfaces (D-A transducer) 57, 58 are provided so that the servomotors 10, 15 can be driven respectively by control signals (pulse signals) from the microcomputer 53.

In addition, a relay interface 60 and a voltage circuit for relay 61 are provided so that the electromagnetic clutches 17, 22, the cutting blade 33 for the cutting mechanism and actuators and the like for the terminal forming mechanism 59 can optionally be driven by control signals from the microcomputer 53, respectively.

The microcomputer 53 is also connected to each of the detecting heads 35–39 and 43–45 through a detection control unit 62, a digital voltmeter 63, a controller 64 and the like, whereby the detection of inferior products in the forming of the torsion spring, the variance of desired dimensions and the like can be fed back to the microcomputer 53.

Figure 8:
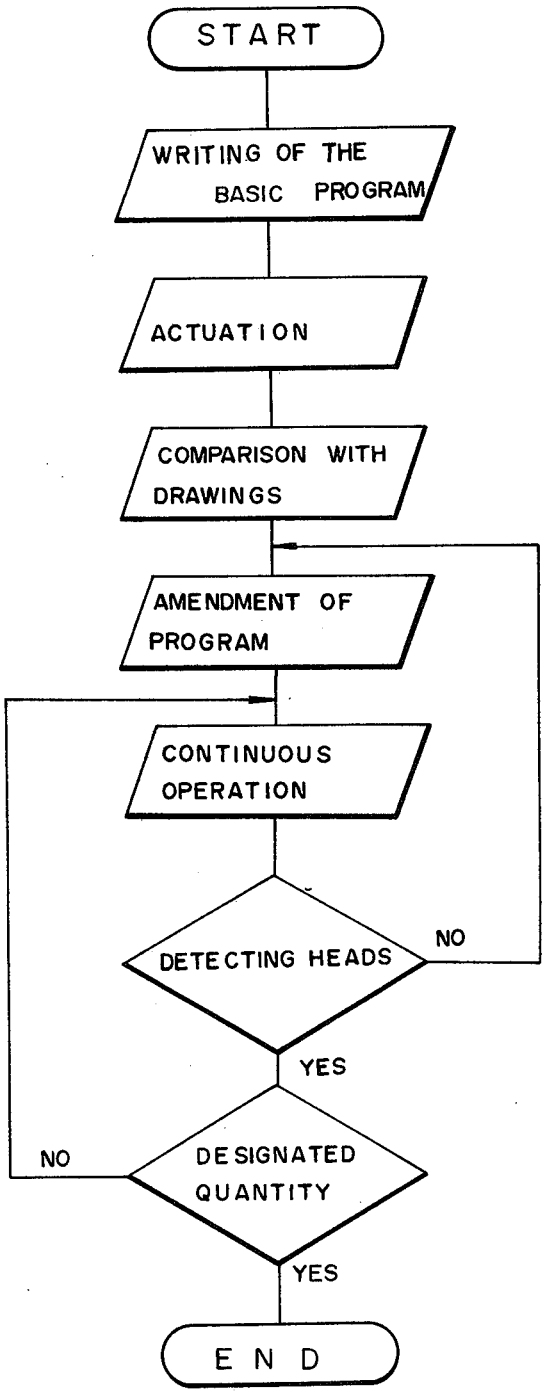
FIG. 8 is a flow chart showing the production procedure of the torsion spring.

When the torsion spring is manufactured by the wire forming apparatus of the above mentioned structure, data based on the specifications of the torsion spring to be produced are first supplied into the input unit 54 as shown in FIG. 8. That is, all of production information including quantity, number of coils, pitch, each end length (developed length in case of the terminal forming), and the like of the torsion spring are supplied as an integer into the input unit 54 to conduct the writing of the basic program. In this case, the number of coils is written as the number of turns and angle of the spindle 6. The pitch and the feeding length of the wire are written as the length. Then, this data is processed by the microcomputer 53 and the processed data is converted into pulse signals which are read out as control signals from the central information processing unit 50.

Since the feeding length of the wire is a total length of the front end portion extending over the center of the arbor 2, the rear end portion extending from the exit of the cutting guide 32 to the center of the arbor 2 and the coiled portion of the torsion spring, when the feed rollers 25, 26 reach the numbers of revolution corresponding to the feeding length of the wire, the microcomputer 53 stops the driving of the feed rollers 25,26. Moreover, in the case where the detecting head 35 is provided for detecting the feeding length of the wire 5, when the front end of the wire 5 is detected by the detecting head 35, the detecting signal is fed back to the microcomputer 53 whereby the rotation of the feed rollers 25, 26 is stopped. Subsequently, if it is intended to perform the terminal forming of the front end portion, the driving signal is supplied from the microcomputer 53 to the actuator or the like in the terminal forming mechanism 59 to begin the forming.

After the completion of the terminal forming of the front end portion, the servomotor 15 and the electromagnetic clutch 17 are actuated to move the spindle box 7, whereby the arbor 2 is shifted to the feeding position of the wire 5. In this way, the wire 5 is inserted between the arbor 2 and the pawl 4 during which the moving limit of the spindle box 7 is detected by the detecting head 38. This detecting signal is fed back to the microcomputer 53 from which a pulse signal for driving the servomotor 10 is supplied to begin the rotation of the arbor 2. Moreover, if the front end portion is not formed into a given shape, the detecting signal of the detecting head 36 is fed back to the microcomputer 53 whereby the operation of the apparatus is stopped.

In the illustrated embodiment, the servomotor 15 serves both as a servomotor for feeding the wire 5 and a servomotor for moving the arbor 2 in the axial direction. As a result, after the completion of the feeding of the wire 5 by the servomotor 15, the electromagnetic clutch 22 is cut off and then the servomotor 10 is actuated to perform the rotation of the arbor 2 and at the same time the electromagnetic clutch 17 is connected to the servomotor 15, whereby the arbor 2 is moved to the axial direction at an interval corresponding to the pitch of the torsion spring. Therefore, the feeding of the wire 5 and the axial movement of the arbor 2 are not simultaneously performed. Thus, the feeding of the wire 5 and the axial movement of the arbor 2 are performed by the change-over of both the electromagnetic clutches 17, 22. At the change-over, the servomotor 15 is stopped so that the relative velocity at the detaching of the electromagnetic clutches 17, 22 becomes zero. Therefore, when the electric current flowing into the electromagnetic clutch 17 is supplied earlier by the time constant of the clutch 17 through the central information processing unit 50 and then the electric current flowing into the servomotor 15 is supplied at the change-over, the power from the servomotor 15 is transmitted through the electromagnetic clutch 17 after the connection of the clutch 17 starts up completely so that the occurrence of slipping can be completely prevented.

Then, the rotation of the arbor 2 is stopped after the number of rotations reaches a predetermined value. However, in order to prevent the spring back of the torsion spring at the cutting step, the arbor 2 is rotated in the reverse direction by an angle required for removing the spring back. Thereafter, the actuator or the like for the cutting blade 33 is driven by control signal from the microcomputer 53. If it is intended to form the rear end portion, the terminal forming mechanism 59 is driven and the detection of the dimensions is performed by the detecting head 37.

Then, the produced torsion spring is referred to the specifications to make the correction of the basic program, if necessary, and then the continuous operation is started. During the continuous operation, detections by the detecting heads 35–39 and 43–45 are performed continuously and the values of the basic program can automatically be modified, whereby the torsion spring with a higher dimensional accuracy can continuously be produced. If an inferior product is detected during the continuous operation, a damper of a chute for the product is moved selectively in accordance with the control signals from the detecting heads 35–39 and 43–45 whereby the selection of the products can automatically and easily be performed. When the production quantity of the torsion spring reaches the predetermined value, the continuous operation is stopped.

In the above production steps of the torsion spring, it is desirable to coordinate all of the required command systems into a single function key and write all numerical values by ten keys, so that the operation can easily be performed by a simple program even by unskilled computer persons.

Further, a malfunction can easily be prevented by displaying all input states on display means such as LED or the like in every address in the input unit 54. If the malfunction is caused, it is desirable to immediately recognize such malfunction by the lightening of an error lamp.

Moreover, this apparatus has the function to exchange a mode by the mode switch, that is "auto", "one cycle", "memory", "one step" and the like in accordance with each section of the automatic operation, adjusting operation and the like. In this case, the "auto" performs the continuous operation except for the time after the production of required quantity, the time of the end of the feeding wire and the time of the emergency stop, the "one cycle" performs the stop after the forming of one torsion spring for adjusting the dimension and the like, the "memory" performs the recording of the program into a cassette tape, and the "one step" performs the repeating of start and stop every one step in the adjusting process or performs reading out of the necessary step only by a jumping function.

In case a regenerating the program recorded in the tape, the necessary portion of the tape is read out so as to supply it to the microcomputer through the input unit 54. In this case, it is desirable to avoid the erroneous input by displaying a code number in the display part of the input unit 54.

It is necessary that the microcomputer 53 to be used in the apparatus for the production of torsion springs possess various operational processing functions, judgement processing functions and jumping functions.

That is, the operational processing functions includes the display function of counter by arithmetic calculation, the display function of time required for producing a residual quantity to the predetermined quantity by the calculation of the required time at one cycle, the calculating function of residual pulse signals for preventing the disordering of the servomotors, the judging functions of normal or reverse rotation when the arbor 2 returns to the original position, and the like.

Further, the judgement processing functions and jumping functions includes the judging function in the action of the various detecting mechanisms, for example, the function of emergency stop in the occurrence of inferior product, the function for continuing the operation, the function for correcting the counter after the removal of inferior product, and the function for stopping after jumping to the cutting step at the returning process after the emergency stop.

The servomotors 10, 15 to be used in the invention possess the function of determining the position and angle in accordance with the input signals. Alternatively a pulse motor, stepping motor or the like can be used having the same functions as described above. As the detecting heads 35–39 and 43–45 to be used in the various detecting mechanisms, conventionally known sensors such as ON-OFF type reed switch, transducer capable of continuously detecting a displacement and the like can be used along or in optional combination thereof.

According to the invention, the production of the torsion spring can automatically be performed by supplying the data required for the production of the torsion spring to the microcomputer and performing the rotation of the arbor, the axial movement of the arbor, the feeding of the wire, the terminal forming, the cutting of the wire and the like on the basis of control signals from the microcomputer. Further, the invention makes it possible to easily produce the torsion spring with a complicated shape because there is no use of the conventional crank slide mechanism. Moreover, the stored program can automatically be corrected by feeding back the control signals from the detecting mechanisms to the microcomputer so that the torsion spring with a higher dimensional accuracy can be produced without being influenced by the dispersion of the wire hardness, wire curl and the like. In addition, the operation of the apparatus can be performed only by supplying the required basic data to the input unit so that easy operation is possible even by the unskilled person.

What is claimed is:

1. A wire forming apparatus for producing torsion springs, comprising:

a first servomotor for rotating an arbor having a diameter corresponding to a central diameter of said torsion spring to be produced;

feed rollers for feeding a wire onto said arbor;

a second servomotor for reciprocally moving said arbor in an axial direction in accordance with a desired pitch for said torsion spring, said second servomotor rotating said feed rollers to feed said wire onto said arbor;

a terminal forming mechanism provided around said arbor for forming terminals of said torsion spring;

a cutting mechanism provided between said arbor and said feed rollers for cutting said wire;

a microcomputer adapted to generate control signals for controlling said first and second servomotors, said terminal forming mechanism and said cutting mechanism;

an input unit connected to said microcomputer for supplying torsion spring data required for generating said control signals;

a detecting mechanism connected to said microcomputer for supplying second signals detected during the production of said torsion spring to said microcomputer so that said microcomputer can generate additional control signals thus achieving feedback control; and said detecting mechanism comprising a first detecting unit placed at a predetermined position apart from said arbor for detecting a fitness of a feeding length of said wire, a second detecting unit provided around said arbor for detecting a fitness of the shape of said terminal after said terminal forming, a third detecting unit provided near said arbor for detecting a limit position of said reciprocal movement of said arbor in said axial direction, a fourth detecting unit provided around a spindle of said arbor for detecting the returning of said arbor to its original position prior to producing said torsion spring, a fifth detecting unit provided around said arbor for detecting a variance of a winding angle of said torsion spring, and a sixth detecting unit provided between said feed rollers and a wire supply source for detecting a final end of said wire.

2. The apparatus as claimed in claim 1, wherein said microcomputer comprises a memory unit for storing said data inputted by said input unit and a central processing unit for processing said stored data received from said memory unit and said second signals from said detecting mechanism.

3. The apparatus as claimed in claim 1, further comprising changeover means connected to said second servomotor for actuating said second servomotor so that said reciprocating movement of said arbor causes said feed rollers to rotate.

4. The apparatus as claimed in claim 3, wherein said changeover means comprises two electromagnetic clutches.

5. The apparatus as claimed in claim 1, wherein said second servomotor comprises third and fourth servomotors, said third servomotor reciprocally moving said arbor in said axial direction and said fourth servomotor rotating said feed rollers to feed said wire onto said arbor.

* * * * *